US010815623B2

(12) United States Patent
Coats et al.

(10) Patent No.: US 10,815,623 B2
(45) **Date of Patent: *Oct. 27, 2020**

(54) APPARATUS AND METHOD FOR REPAIRING WORN RAIL SHOULDERS

(71) Applicant: Pandrol Limited, Surrey (GB)

(72) Inventors: Frank Howard Coats, Thorofare, NJ (US); Scott Tripple, Philadelphia, PA (US); Todd Finley, Laurel Springs, NJ (US); Dillon Alves Benros, Philadelphia, PA (US)

(73) Assignee: PANDROL LIMITED, Surrey (GB)

( * ) Notice: Subject to any disclaimer, the term of this patent is extended or adjusted under 35 U.S.C. 154(b) by 419 days.

This patent is subject to a terminal disclaimer.

(21) Appl. No.: 15/651,644

(22) Filed: Jul. 17, 2017

(65) Prior Publication Data

US 2019/0017227 A1 Jan. 17, 2019

(51) Int. Cl.
*E01B 31/18* (2006.01)
*E01B 29/32* (2006.01)

(52) U.S. Cl.
CPC ..... *E01B 31/18* (2013.01); *E01B 29/32* (2013.01)

(58) Field of Classification Search
CPC ..... E01B 31/18; E01B 29/32
See application file for complete search history.

(56) References Cited

U.S. PATENT DOCUMENTS 2,076,019 A * 4/1937 Fifield ..... E01B 9/686 238/283
2,989,240 A * 6/1961 Lansing ..... E01B 11/54 238/244
3,311,331 A * 3/1967 Steimen ..... F16F 1/376 248/633
4,047,663 A 9/1977 Reynolds et al.
4,155,507 A 5/1979 Chierici et al.
4,316,578 A 2/1982 Reynolds et al.
4,572,431 A 2/1986 Arato
4,632,308 A * 12/1986 Fischer ..... E01B 9/483 238/265
4,648,554 A 3/1987 McQueen
4,688,719 A 8/1987 Young et al.
5,022,584 A 6/1991 Sherrick
5,110,046 A 5/1992 Young
5,261,599 A 11/1993 Brown
5,335,850 A 8/1994 Igwemezie
5,405,081 A 4/1995 Bosshart
5,520,330 A 5/1996 Brown et al.
5,549,245 A 8/1996 Kish
5,551,633 A 9/1996 Kish et al.
(Continued)

OTHER PUBLICATIONS

Spikefast® SRP-210, Concrete Shoulder Repair Product, Willamette Valley Company, http://www.wilvaco.com, May 2012.

*Primary Examiner* — Jason C Smith

(74) *Attorney, Agent, or Firm* — Gottlieb, Rackman & Reisman, PC

(57) ABSTRACT

In a railroad system a track includes ties positioned at predetermined intervals and supporting a pair of rails. Shoulders are disposed in pairs adjacent to the sides of each rail and are partially imbedded in the ties to limit the lateral movement of the rails and define the track gauge. Over time, friction between the insulators and the shoulders may cause excessive wear and a gap therebetween. This wear is compensated by a shim attached to the shoulders.

3 Claims, 8 Drawing Sheets

(56) References Cited

U.S. PATENT DOCUMENTS

| | | | | |
|---|---|---|---|---|
| 5,566,882 | A | 10/1996 | Brown et al. | |
| 5,735,458 | A | 4/1998 | Brown et al. | |
| 6,045,052 | A | 4/2000 | Besenschek | |
| 6,386,461 | B1 | 5/2002 | Wildgoose | |
| 6,481,637 | B1 | 11/2002 | McQueen | |
| 7,080,791 | B2 * | 7/2006 | Geissele | E01B 9/303 238/264 |
| 7,690,584 | B2 * | 4/2010 | Geissele | E01B 9/68 238/264 |
| 2009/0090790 | A1 * | 4/2009 | Coats | E01B 31/02 238/287 |
| 2019/0017227 | A1 * | 1/2019 | Coats | E01B 29/32 |

* cited by examiner

APPARATUS AND METHOD FOR REPAIRING WORN RAIL SHOULDERS

FIELD OF INVENTION

The present invention relates generally to an apparatus and method for repairing shoulders of a railroad system that are attached to ties to hold rails in place and more specifically, to a shim and method of attaching the shim to a shoulder of a railroad system to compensate for material loss due to extended wear of the shoulder.

BACKGROUND OF THE INVENTION

Railroad systems are commonly used in many parts of the world as a means of transportation (e.g., for freight and people). Railroad systems typically include rails that are supported on ties (e.g., commonly comprised of concrete) by a pad that is positioned between two shoulders (e.g., commonly comprised of iron). More specifically, a resilient pad is disposed between two shoulders on ties with plastic insulators coupled to the pads and abutting each of the shoulders. The pads are resilient to provide a smoother ride for the train and to compensate for slight size and position variations of the ties. As each of the wheels of a moving train passes over each of the ties, the weight of the train causes the rail to travel slightly downward on the pad, causing the sides of the plastic insulators to rub against a face of the shoulders. Over time, this repeated action causes noticeable wearing of the shoulder face. This erosion is increased when sand and other abrasive particles are lodged between the insulator and the shoulder face. The same action causes a wear on the sides of the insulators as well. This gap can be sufficiently large to allow the pad disposed between two adjacent shoulders and the rail associated with the worn shoulder to shift. In some instances, this lateral shift can be sufficiently large to cause the gauge to be too wide to meet the standard railroad specifications.

Plastic insulators are designed to last as long as rail sections and therefore it is relatively easy and simple to replace worn insulators (and pads, if necessary) at the same time as the rails. However, the shoulders are embedded into concrete ties and cannot be removed therefrom. Therefore, until now, the only way to correct for excessive wear of a shoulder face was to replace the entire concrete tie, which is a very expensive and time consuming process.

SUMMARY OF THE INVENTION

The present invention relates generally to a shim that is disposed between two components to address gaps or voids created over time between a shoulder and an insulator of a rail support. The shim, which can be made of steel plate or a similarly durable material, can be sized and shaped to cover the worn face of the shoulder. The shim can be attached to the shoulder, for example, by an adhesive, such as an epoxy.

In an embodiment, to fill a gap(s) or void(s) in a shoulder of a railroad system, the shim is inserted and attached to the respective shoulder. In another embodiment, a section of track is removed from the ties, with the original shoulders remaining imbedded in the ties. The existing rails and rail supports (e.g., plates, pads, clips, insulators, etc.) are replaced with new ones as needed and shims are attached to the shoulders as part of the replacement process. In another embodiment, the shims are incorporated or imbedded into the insulators prior to the replacement process.

DETAILED DESCRIPTION OF EMBODIMENTS OF THE INVENTION

Figure 1:
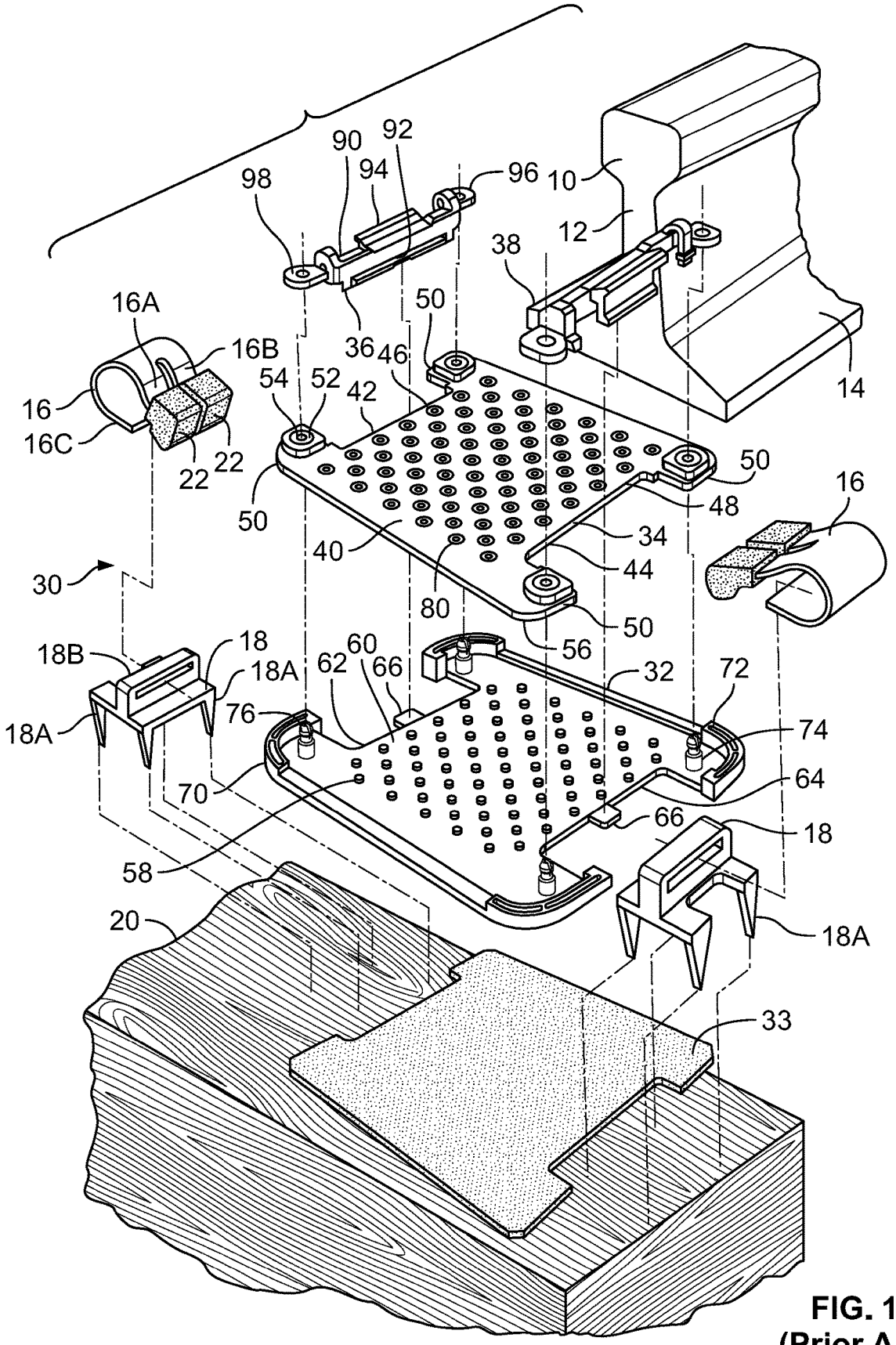
FIG. 1 (Prior Art)
FIG. 1 is an exploded view of a known rail support assembly.

FIG. 1 shows a known rail fastening system, which is described in detail in commonly assigned U.S. Pat. No. 7,690,584. In FIG. 1, a portion of a standard rail 10 that includes a web 12 and a flange 14 is shown. The rail 10 is supported on a tie 20 (e.g., concreate tie) by a fastener 30. A curved clip 16 that can, for example, be made of steel is attached to a shoulder 18 that is imbedded in the tie 20. The clip 16 has two arms 16A, 16B and a base 16C. The arms 16A, 16B are each terminated with a respective wedge 22 that push down on the flange 14.

The shoulder 18 includes a plurality of legs 18A that are configured to penetrate the tie 20. In this manner, a fastener 30, which includes an abrasion plate 32, a bottom pad 33, which could be a foam gasket or other material, a top pad 34 and two insulators 36, 38, is sandwiched between the rail flange 14 and the tie 20.

The top pad 34 can be made of a high impact plastic and include a generally H-shaped outline with a main body 40 and two transversal sides 42 and 44 (the terms transversal and longitudinal are used herein with reference to the longitudinal axis of rail 10).

The sides of pad 34 are formed with two respective rectangular cutouts 46 and 48 designed to wrap around the insulators 36, 38, respectively, as seen in FIG. 1. The sides 42, 44 are formed with two arms 50, each having a raised cylindrical boss 52. The through holes 54 extend through the pad 34. The arms 50 have curved sides 56.

The pad 34 also has a first set of circular dimples 80 on its top surface and a second set of circular dimples (not shown) on its bottom surface. The two sets of dimples have the same size dimples but the dimples on the bottom surface are laterally offset so that they do not match the positions of top dimples 80. Both sets of dimples are distributed evenly across respective surfaces of the pad 34. It has been shown that patterns with this distribution are effective in converting the vertical forces on the rails 10 and fasteners 30 can be effectively diffused and spread across the surface of pad 34.

The abrasion plate 32, which can be made of a high impact plastic and is generally H-shaped with a flat portion 60 and two transversal sides with cutouts 62 and 64 similar to cutouts 42, 44 on the pad 34. The plate 32 further includes arms 70 disposed along the cutouts 62, 64. Tabs 66 are provided in the middle of each cutout 62, 64. Each arm 70 is formed with a raised wall 72 having an arcuate shape. These walls 72 are sized and shaped so that they are complementary to the curved sides 56.

Figure 1A:
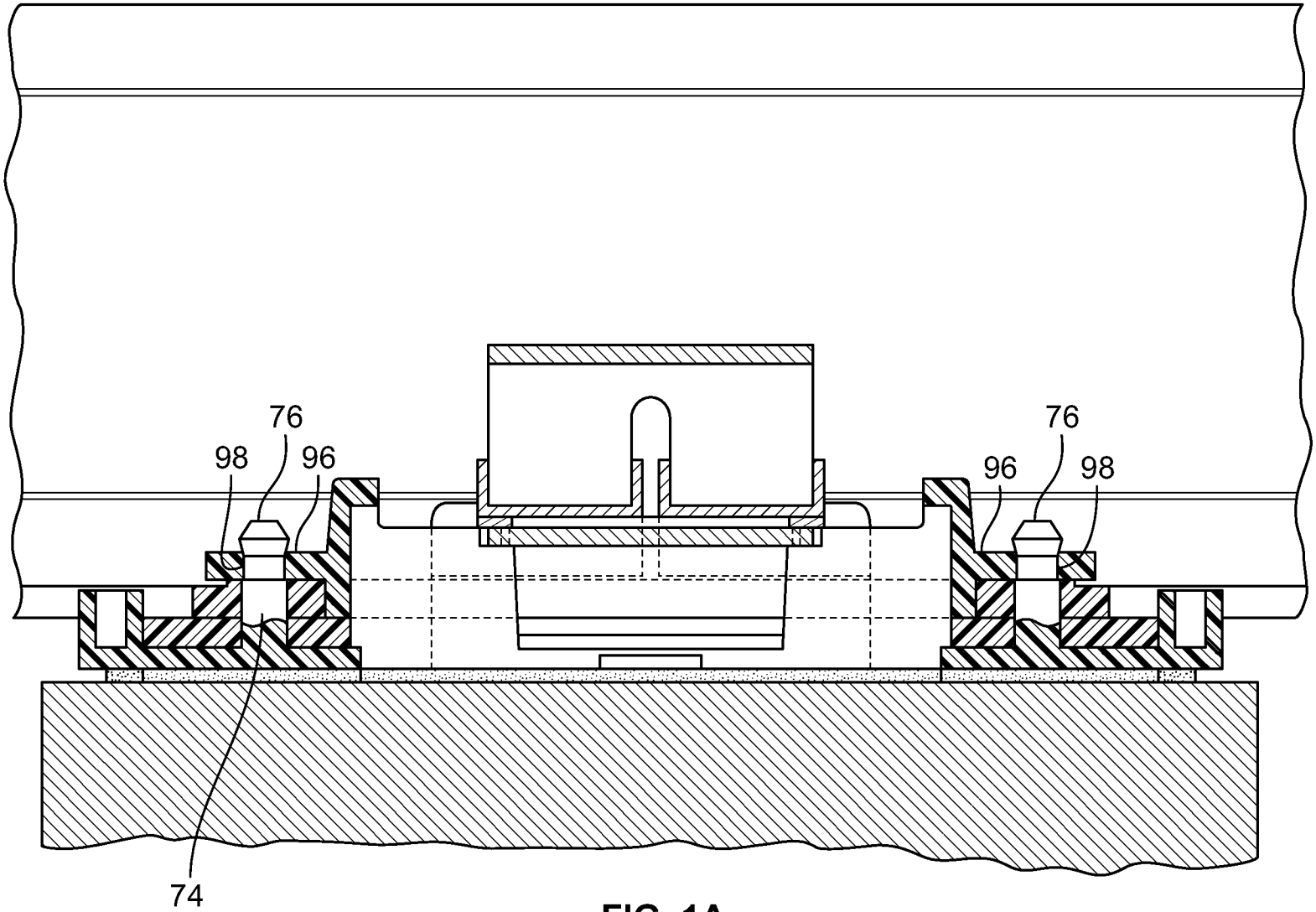
FIG. 1A (Prior Art)
FIG. 1A is a cross-sectional view of the known rail support assembly of FIG. 1.

Each arm 70 also holds a coupling stalk 74 rising vertically upwards, above, the flat portion 60 as seen in FIG. 1A. Preferably, each stalk terminates with a mushroom shaped head with a split (not shown). The split is formed to render the head 76 radially flexible so that it can be bent or collapsed radially inwardly thereby reducing the effective diameter of the head 76 so that it can fit through hole 54 in the pad 34.

The flat section 60 is formed with a pattern of protrusions 58 on its top surface 60. The protrusions 58 are evenly distributed at least on the portion of the plate 32 that is below rail 10. The protrusions 58 are constructed and arranged so that when the pad 34 is positioned on top of plate 32, each protrusion 58 fits and extends into a matching dimple on the bottom surface of the pad 34. Preferably, the diameter of the dimples is larger than protrusions 58. The diameter of a portion of the stalks 74 disposed below their heads 76 is also smaller than the diameters of holes 54. Thus, the elements of the plate 32 and pad 34 are dimensioned to allow the pad 34 and plate 32 to shift laterally with respect to each other.

Figure 3:
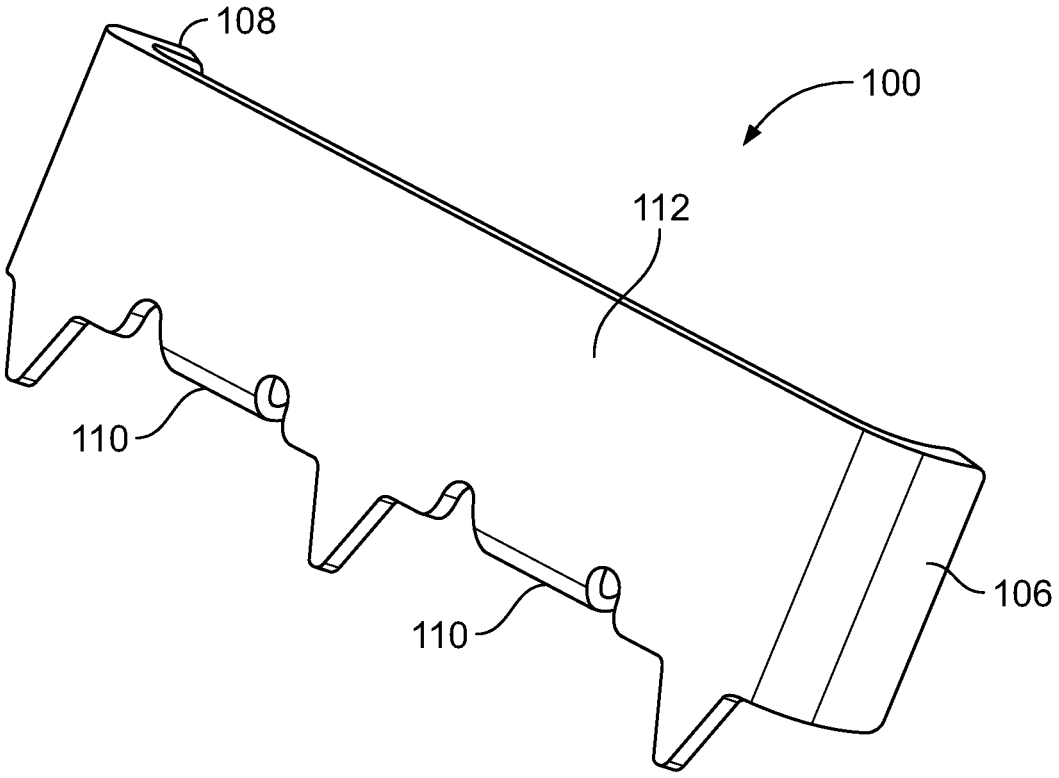
FIG. 3 is an elevation view of a shim of the rail support system of the present invention.

The insulators 36 and 38 are also made of a high impact plastic material. Each has an elongated body 90 with a side wing 92, as shown in FIG. 3. At one top edge, the body 90 is formed with an edge 94. Each insulator is seated on one of the tabs 66 and the steel shoulder 18. The shoulder has a lip 19 and each insulator 36, 38 is shaped so that that its body 90 and the wing 92 straddle the lip 19. The clip 16 is positioned so that the base 16C extends through a hole 19B and abuts the wing 92. The clip 16 is maintained in this position by edge 94. The remaining portion of the clip 16 extends over the shoulder 18 and the insulator 36 so that the coil end with the insulator 22 rests and presses down on the rail 10.

Preferably, each insulator is provided at its longitudinal ends with respective round extensions 96. Each extension is formed with a hole 98, as shown in FIG. 1A. Hole 98 has a diameter larger than the diameter of the portion of stalk 74 disposed under the head 76.

The elements of the fastener 30 are assembled together by placing the pad 34 over the plate 32 and pushing it down to force the four stalks 74 through holes 54. The insulators 36, 38 include openings 98 that are then aligned with the stalks 74 and mounted to the stalks 74 such that the plate 32 is arranged between the pad 34 and the insulators 36, 38, thereby forming a fastener assembly that can be easily shipped to a desired destination and used to mount rail 10 on the ties 20.

It is important to note that the two shoulders 18 are embedded carefully into the concrete tie 20 with their faces 18B parallel to each other to engage the respective insulators 36, 38. In addition, the two fasteners 30 are placed at a predetermined distance from each other on each tie 20. This distance defines the spacing or gauge of the rails 10.

Figure 2:
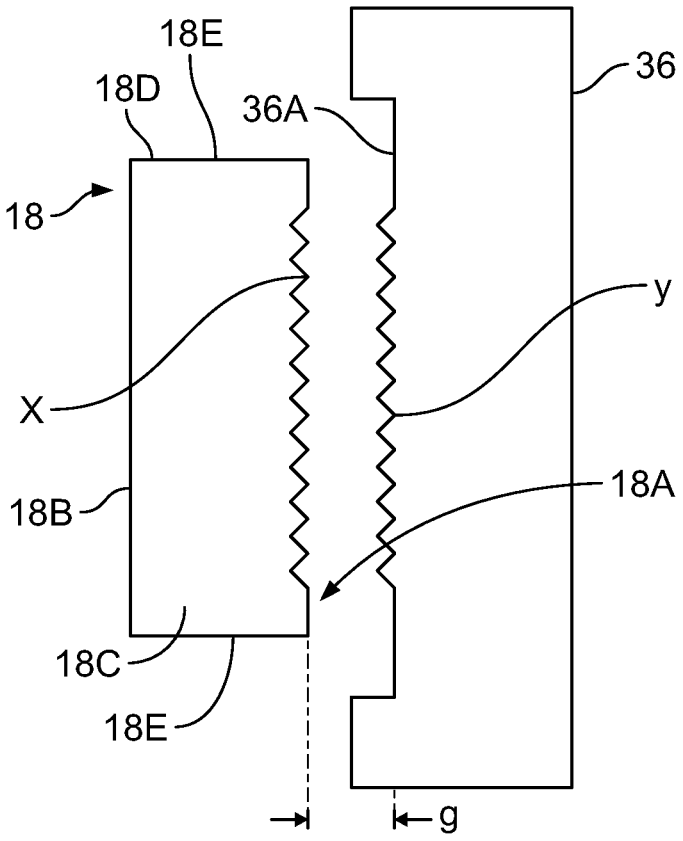
FIG. 2 (Prior Art)
FIG. 2 is a top view of a worn shoulder and worn insulator of a rail support system.

As discussed above, the insulators 36, 38 are made of an electrically insulating material and are provided to provide electrical isolation between the shoulders 18 and rails 10. The insulators are normally attached to the pad and each has a front face 36A that is in contact with the front face 18B of the respective shoulder 18, as shown somewhat diagrammatically in FIG. 2. Each time a railroad wheel rolls over each pad 34, the pad 34 is compressed vertically causing a vertical movement its insulators 36, 38. Since the insulators are in physical contact with respective shoulders 18 at abutting faces 18B, 36A, after a while, these faces become uneven as at X and Y and are worn away, and cause a gap g to form therebetween. This action is accelerated if sand and other extraneous matter is deposited into the gap g. Therefore the pad 34 can creep laterally toward one of the shoulders 18 thereby increasing the lateral spacing between the rails 10 sufficiently so that this distance may exceed the nominal gauge of the track. As discussed above, the insulators 36, 38 can be replaced; however, replacing the shoulders is much more difficult since it can be done only by replacing the whole tie with a new tie and new shoulders.

A shoulder 18 typically has a body 18D that includes a front face 18B, a top surface 18C and two side walls 18E. As shown in FIG. 1, the shoulder 18 includes two legs 18A that extend downwardly and are configured to be set into tie 20 for mounting the shoulder 18 thereto. It should be understood that the shoulder described herein is one of many different types of shoulders that are presently available from different manufacturers. These shoulders may have different shapes and sizes then what is shown herein.

Figure 4:
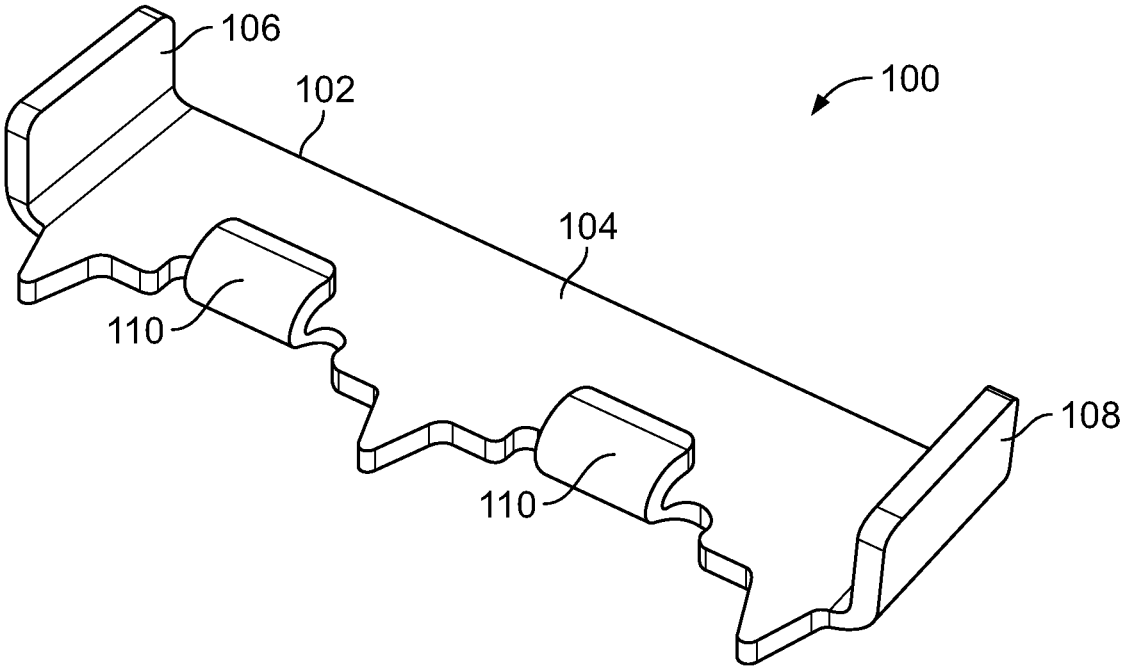
FIG. 4 is a top view of the shim of FIG. 3.

According to the present invention, a worn shoulder can be repaired using a shim 100 sized to fit over the face of the shoulder as shown in FIGS. 3 and 4. Preferably, the shim 100 is made of a thin steel plate that has a uniform thickness, but can be made from other materials as well. Typically, the shim 100 may have a thickness of about 1/16-1/8 inch and may be cut out or stamped from a sheet of metal and then formed to have a generally C-shaped body 102. The body 102 includes a straight central segment 104, two lateral wings 106, 108 matching the shapes of the sides 18B, 18C of shoulder 18. One or more tabs 110 are also provided which matches the top surface 18C. Alternatively, a single tab 110 may be provided that is wide enough to extend across the width of the surface 18C or three or more tabs 110 may be used. The shim 100 is sized and shaped so at least the outer surface 112 of central segment 104 has the same size and shape as the original shoulder face 18B (e.g., before the face 18B is worn).

The shim 100 is attachable to the shoulder 18 using an adhesive such as an industrial-strength epoxy 120. Preferably, the epoxy must be weatherproof since the track systems are frequently installed in locations that are subjected to inclement weather conditions with large temperature and humidity ranges. One such epoxy is available under the name of SRP 210 or Spikefast® Polyurethane available from Willamette Valley Company, Eugene, Oreg. Other adhesives may be used as well. In one embodiment of the invention, the shim 100 is simply attached to the shoulder, with the epoxy 120 and the shim 100 feeling the gap g. However, a better practice is to remove the fastener 30 before installing the shim 100 and replace it, or at least some of its components, as necessary.

Figure 5:
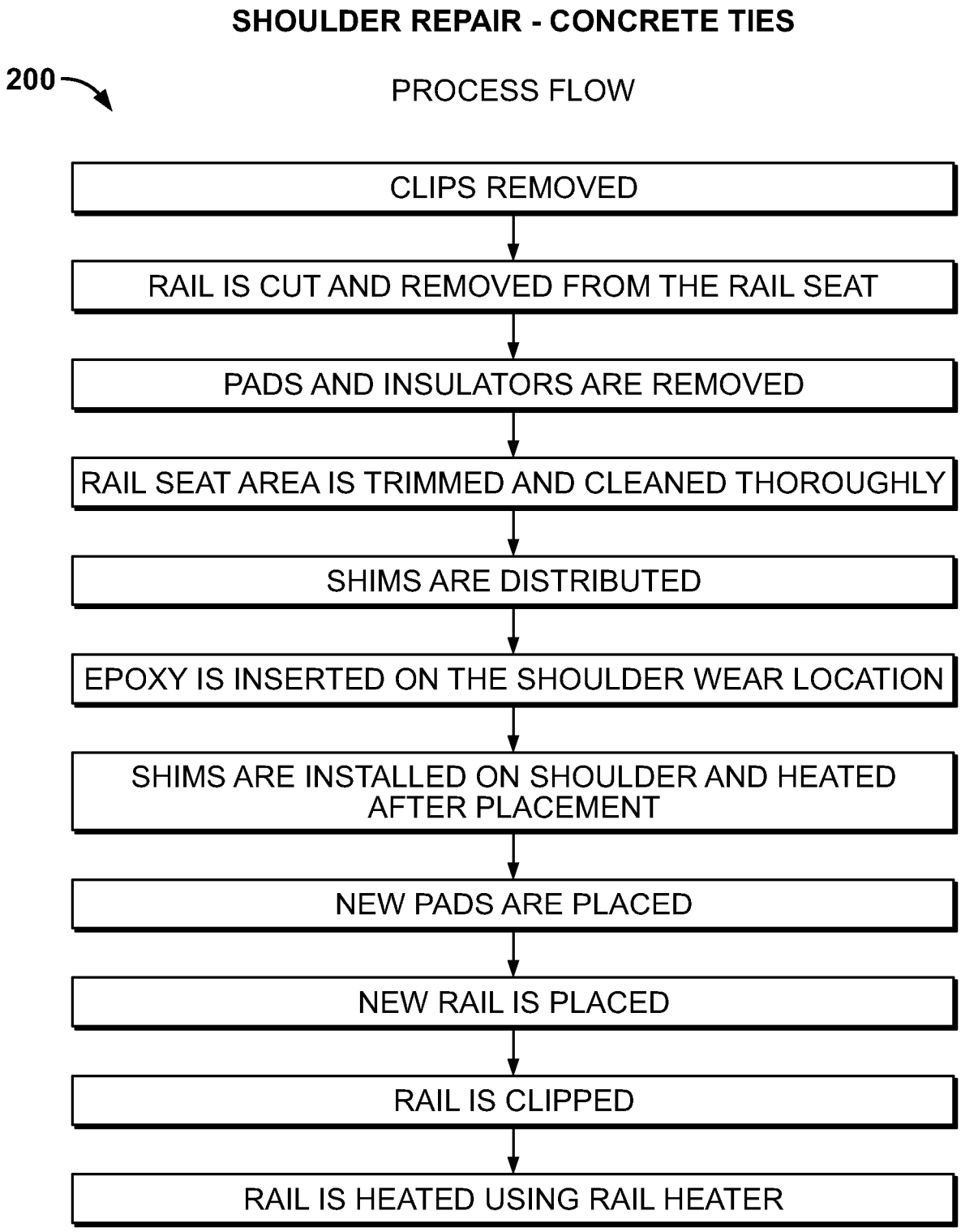
FIG. 5 shows the steps of an embodiment of a process used to install the shim of FIG. 3.
Figure 6:
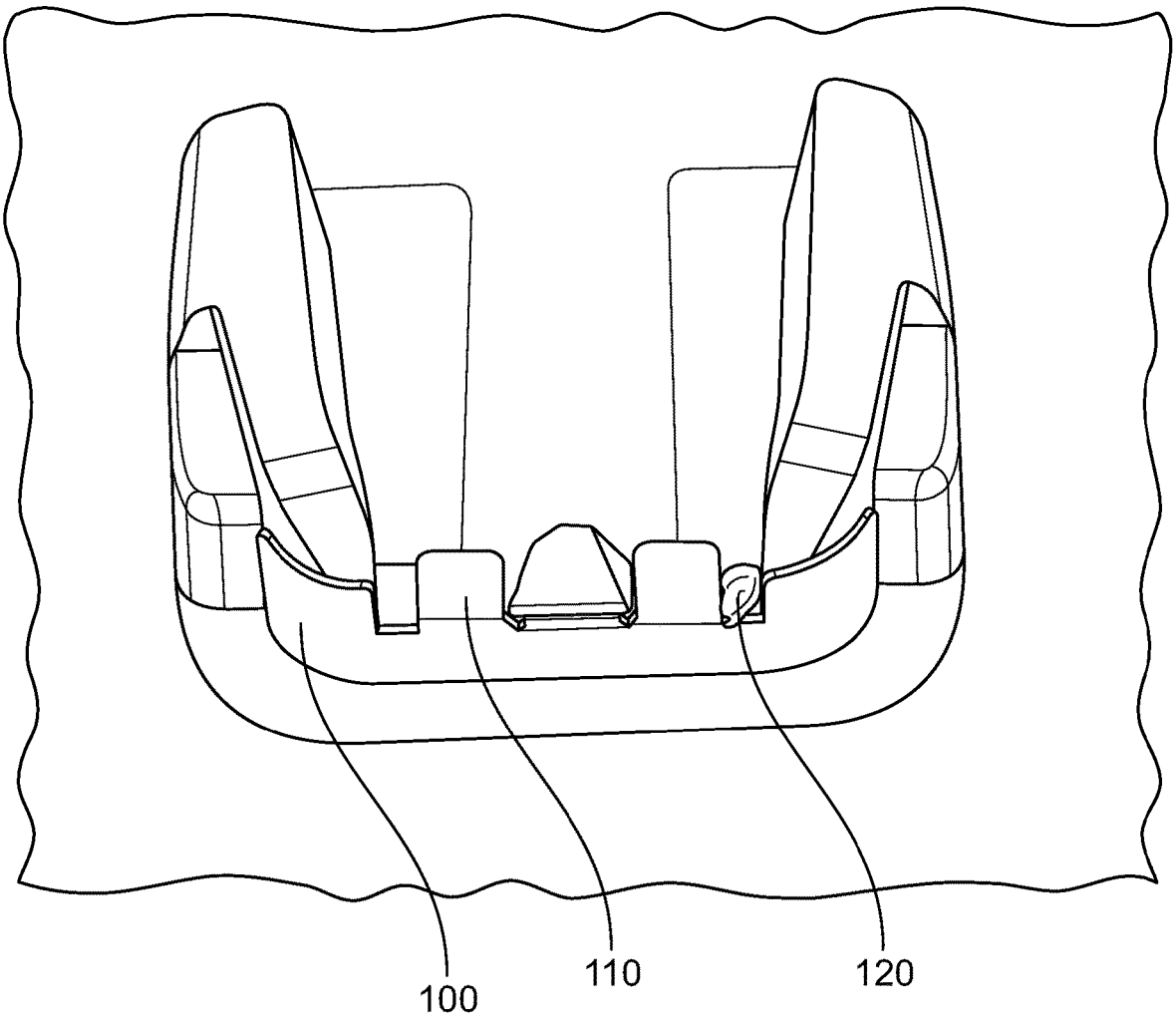
FIG. 6 is an orthogonal view of a shoulder with the shim of FIG. 3

A process 200 for repairing a rail section using a shim is shown in FIG. 5. For this process, it is assumed that a section of rail needs to be fixed with several worn shoulder. First, the clips 16 holding the rails 10 are removed. Next, portions of each rail 10 are cut and the cut rail portions are removed if only the shoulder of one rail is worn, then the other rail is not removed). Next, the fastener 30 is removed. The ties 20 and shoulder 18 are thoroughly cleaned and dried, using a blow torch, if necessary. Next, all the worn shoulders are identified and a shim 100 is provided for each worn shoulder. Next, the epoxy is deposited on worn shoulders. The shims 100 are attached to the respective shoulder 18 and the epoxy 120 is allowed to cure (see FIG. 6). In some instances, depending on various conditions and the kind of epoxy used, heat may be applied during this step, or at a later stage. The amount of the epoxy used can depend on the actual wear of the shoulder. Naturally, more epoxy 120 is used for shoulders with more wear.

Then, preferably new fasteners (including pads and insulators) are installed, if necessary, unless the old ones are good enough. As part of this step, a lubricant such as white lithium grease is applied between the insulators and the shoulder 18 to reduce friction, retard mold formation, etc. Next, a new rail segment is positioned on the rail supports and installed, and clips are installed to hold the rail segment in place. Finally, the ends of the rail segment are welded or otherwise attached to the adjacent rail segments.

The process described in conjunction with the flow chart of FIG. 5 is particularly advantageous at locations where several adjacent shoulders need repairs, or where a segment of rail needs to be replaced or reconditioned anyway as a normal part of maintenance. In an alternate embodiment, e.g., where only one or two shoulders need repair, an abbreviated procedure may be used. In this procedure, the rail is unclipped from several ties (e.g., six ties) and then pulled away laterally from its supports. The pads and insulators are removed, the ties and shoulders are cleaned, the shims are installed on the shoulders with epoxy, and the rail is pulled back to its original position. The rail can be shifted laterally back and forth either manually or with a hydraulically assisted device.

Figure 7A:
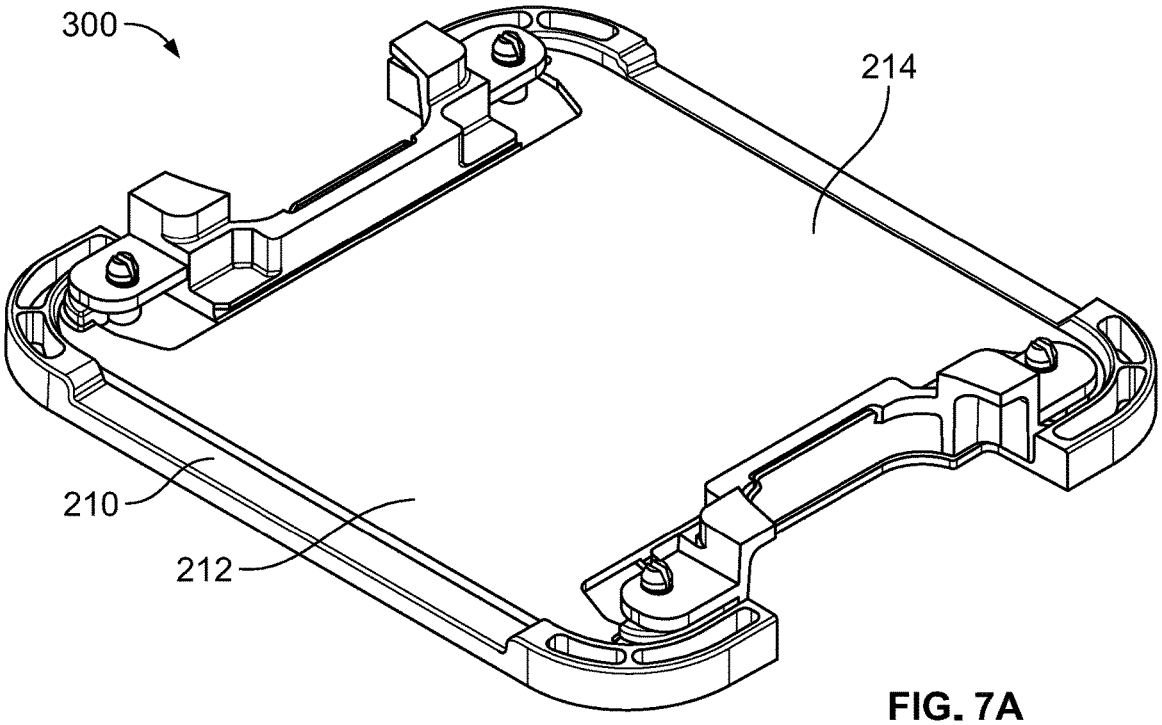
FIGS. 7A and 7B show details of an fastener with incorporated shims.
Figure 7B:
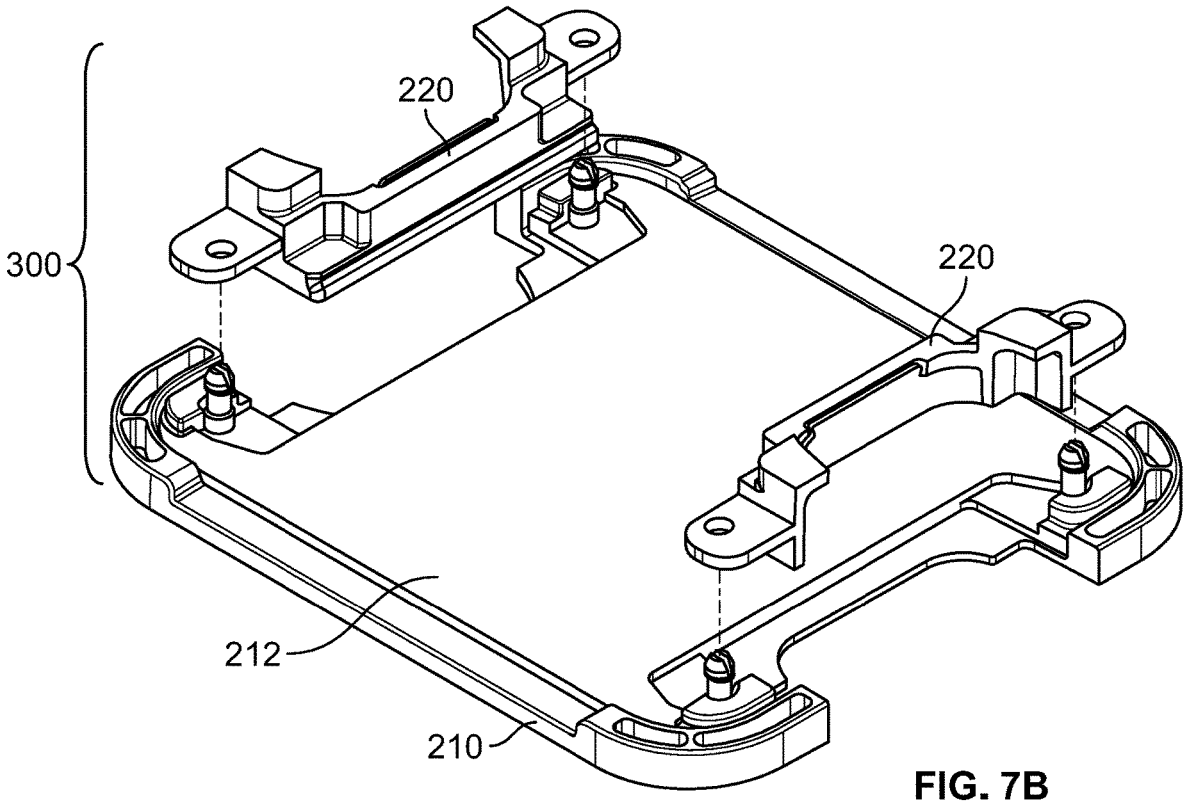

In an alternate embodiment, a fastener 300 is provided that incorporates a shim. As shown in FIGS. 7A and 7B, the fastener 300 includes an abrasion plate 210, a pad 212 and a pair of insulators 220. Except for the shims, the fastener 200 has the same general characteristics as the fastener of FIG. 1. However pad 212 has a smooth top surface 214 and does not have any dimples.

Figure 8:
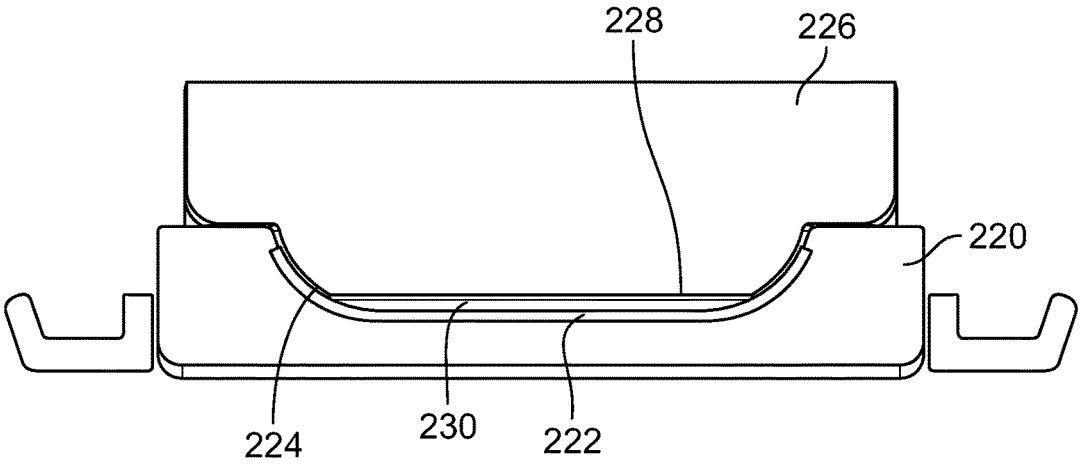
FIG. 8 is a cross sectional view of the insulator of FIGS. 7A, 7B attached to a shoulder in accordance with the present invention.

As can be seen in FIG. 8 (in this figure portions of the insulators 220 used to attach them to the rest of the fastener have been omitted for the sake of clarity), each insulator 220 has an inner vertical face 222 which normally would contact the face of the respective shoulder. However, in this invention, a metallic shim 224 is incorporated into or covers this inner face 222. The shim 224 is similar to shim 100, but it does not have tabs 110.

In this later embodiment, epoxy 230 (see FIG. 8) is applied to the worn face 228 of shoulder 226 and then the fastener 220 is positioned so that the shim 224 abuts and contacts the epoxy 230. The inner surface of shim 224 contacting the epoxy 230 is shaped to match the contour of the shoulder face 228 before it was worn, and epoxy 230 fills the void formed by wear of the shoulder face 228.

Although the description above and figures contains much specificity, the details provided should not be construed as limiting the scope of the embodiments, but merely as describing some of the features of the embodiments. The description and figures should not to be taken as restrictive and are understood as broad and general teachings in accordance with the present invention. While the embodiments have been described using specific terms, such description is for illustrative purposes only, and it is to be understood that modifications and variations to such embodiments, including, but not limited to, the substitutions of equivalent features and terminology may be readily apparent to those of skill in the art based upon this disclosure without departing from the spirit and scope of the invention. For example, in the embodiment described above, the rail is heated after the shim is applied. Alternatively, the rail may be heated by conventional means before the shim is applied. The embodiment described above uses a polyurethane as the adhesive, however other adhesives may be used as well to achieve the same purpose. The embodiment described above includes a shim made of sheet metal. Alternatively, a plastic material, such as a high strength plastic material may be used as well. Whether the shim is made of metal or plastic, it still has a predetermined or rigid shape. Alternatively, the adhesive itself may be used as the shim and it takes the desired shape as the rail and the insulator are assembled.

What is claimed is:

1. A method of repairing worn shoulders of a railroad track fastening system and in turn rebuilding a portion of the railroad track fastening system, the railroad track fastening system including at least one tie, at least one rail secured to the at least one tie by one or more clips, a pair of shoulders configured to restrict the lateral movement of the at least one rail about the at least one tie, a pad disposed between the at least one tie and the at least one rail and insulators that are disposed adjacent to a surface of each of the shoulders, the method comprising the steps of:

removing the clips from the rail;

removing the pad and the insulators;

identifying a worn face of at least one of the shoulders;

providing a replacement pad and replacement insulators that each have an inner vertical face and a shim that is devoid of tabs and one of incorporated into and covers the inner vertical face;

arranging the replacement pad on the at least one tie;

applying an adhesive to a surface of the worn face of the at least one of the shoulders; and positioning at least one of the replacement insulators so that a surface of the shim that is associated with the at least one of the replacement insulators abuts and contacts the adhesive, the surface of the shim contacting the adhesive being contoured to match a contour of a respective worn face of the at least one of the shoulders with the adhesive filling a void formed by wear of the respective worn face of one of the shoulders.

2. The method of claim 1, wherein said shim is made of one of a metal and plastic material.

3. The method of claim 1, wherein the shim is made of sheet metal.

* * * * *